United States Patent [19]

Sanabria

[11] Patent Number: 4,880,327

[45] Date of Patent: Nov. 14, 1989

[54] GRAVITY LOCK BOOKSTAND AND BINDER

[75] Inventor: Ronaldo M. Sanabria, Chicago, Ill.

[73] Assignee: Richard F. Sanabria, Chicago, Ill.

[21] Appl. No.: 245,285

[22] Filed: Sep. 16, 1988

[51] Int. Cl.[4] ..... B42F 13/00; B42F 5/00; B42D 3/00

[52] U.S. Cl. ..... 402/73; 281/33; 402/70; 402/501

[58] Field of Search ..... 281/33; 402/70, 73, 402/50 L

[56] References Cited

U.S. PATENT DOCUMENTS 1,086,906 2/1914 Felten ..... 281/33 X
1,112,041 9/1914 Treadway ..... 281/33
1,564,594 12/1925 Leh ..... 281/33 X
1,659,395 2/1928 Douglas ..... 281/33 X

*Primary Examiner*—Paul A. Bell

[57] ABSTRACT

A combination loose-leaf ring binder and foldable bookstand is quickly erectable and develops increasing stability with increasingly heavier loads under the designed gravity lock principle. Quick closure is effected upon removal of the load. In combination, a juxtaposed pair becomes a larger display stand. Four alternative erected configurations serve as a drawing board, a flip chart easel a lectern and as a copyholder for typing, all at their various appropriate angles. Other embodiments of the bookstand feature extra compact folding and integration with a book cover.

13 Claims, 8 Drawing Sheets

FIG. 2
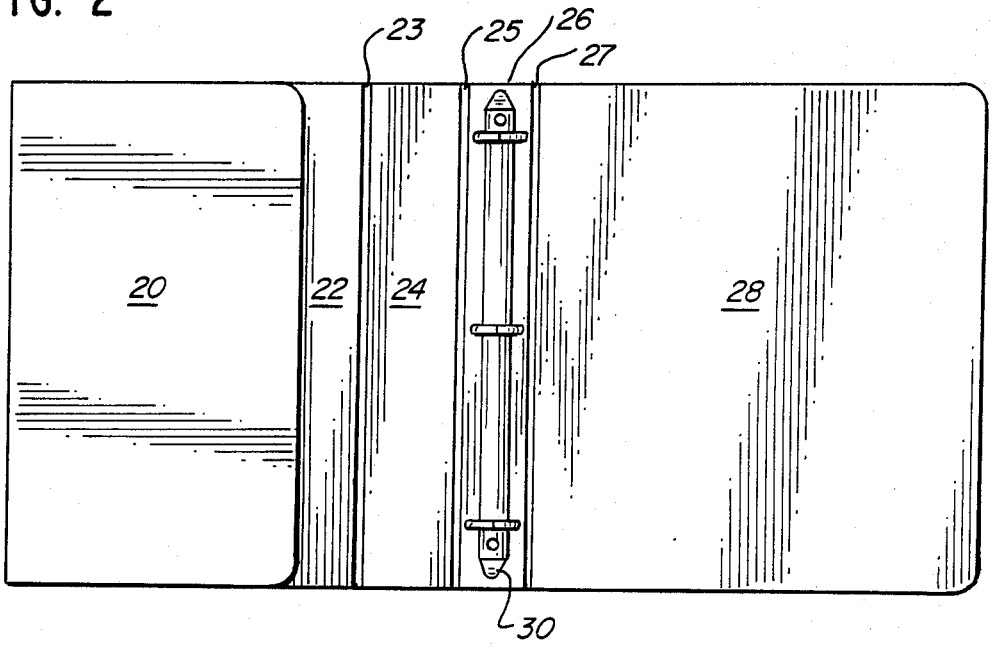
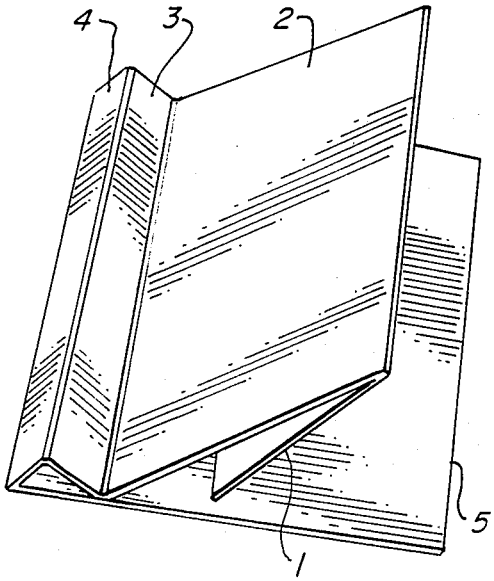
FIG. 4
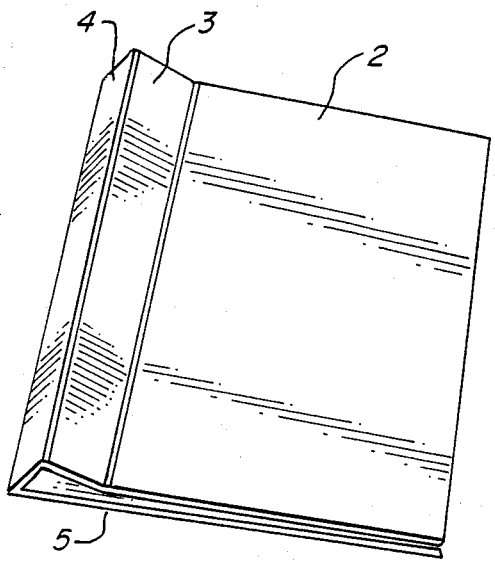
FIG. 3

FIG. 5
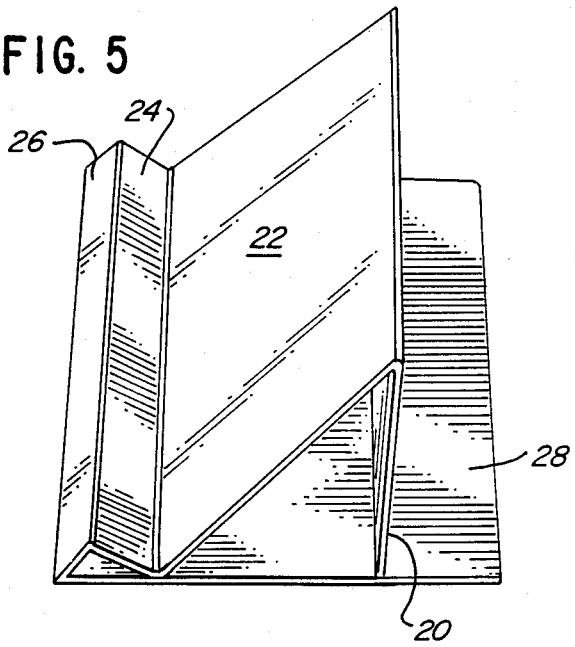
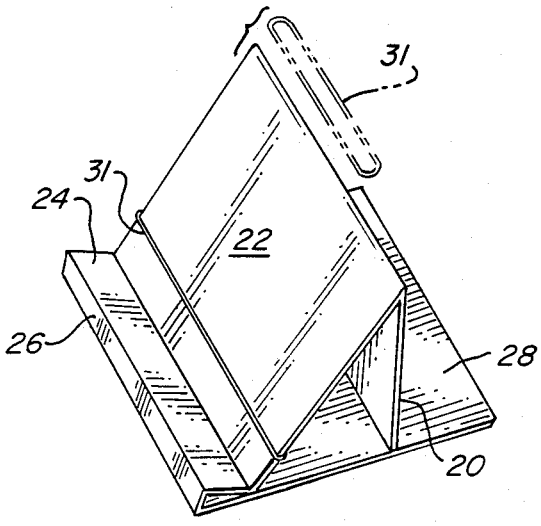
FIG. 6
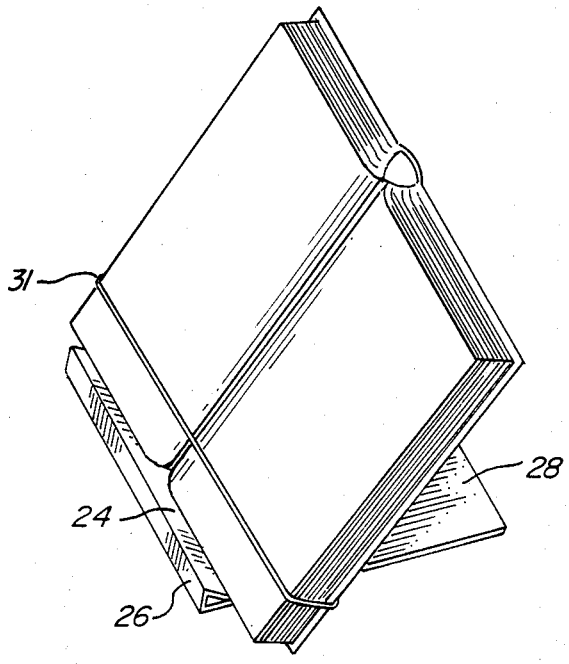
FIG. 7

FIG. 8
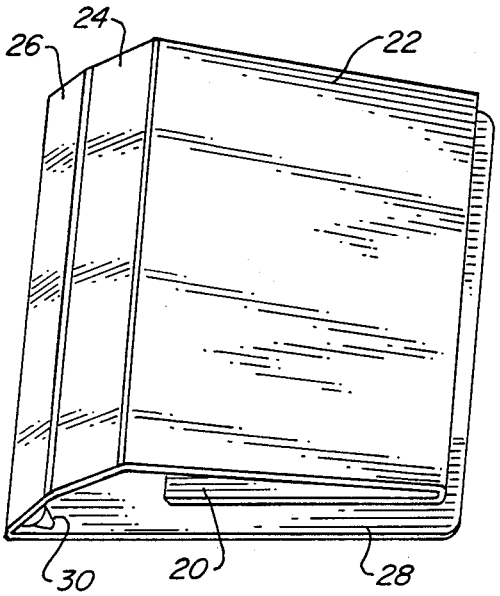
FIG. 9
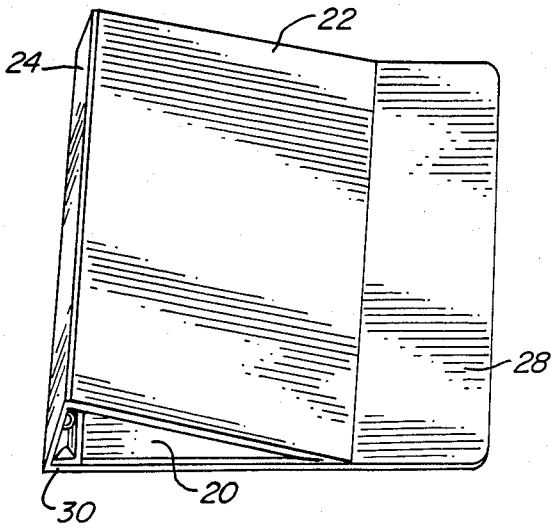
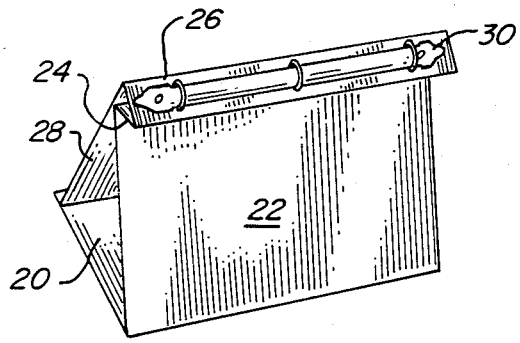
FIG. 12
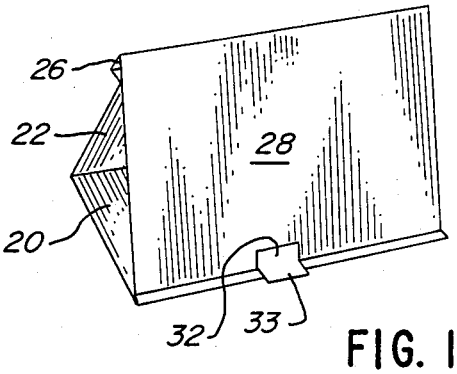
FIG. 13
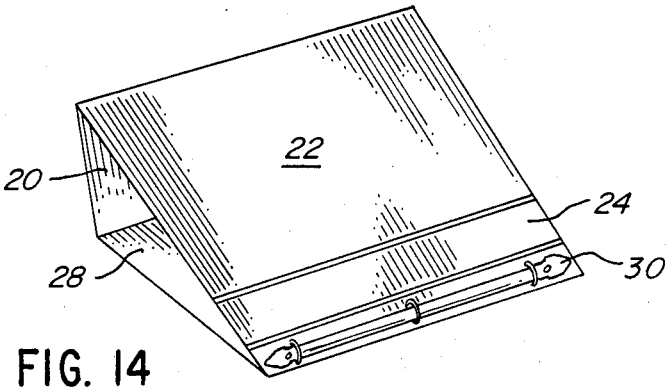
FIG. 14

FIG. 10
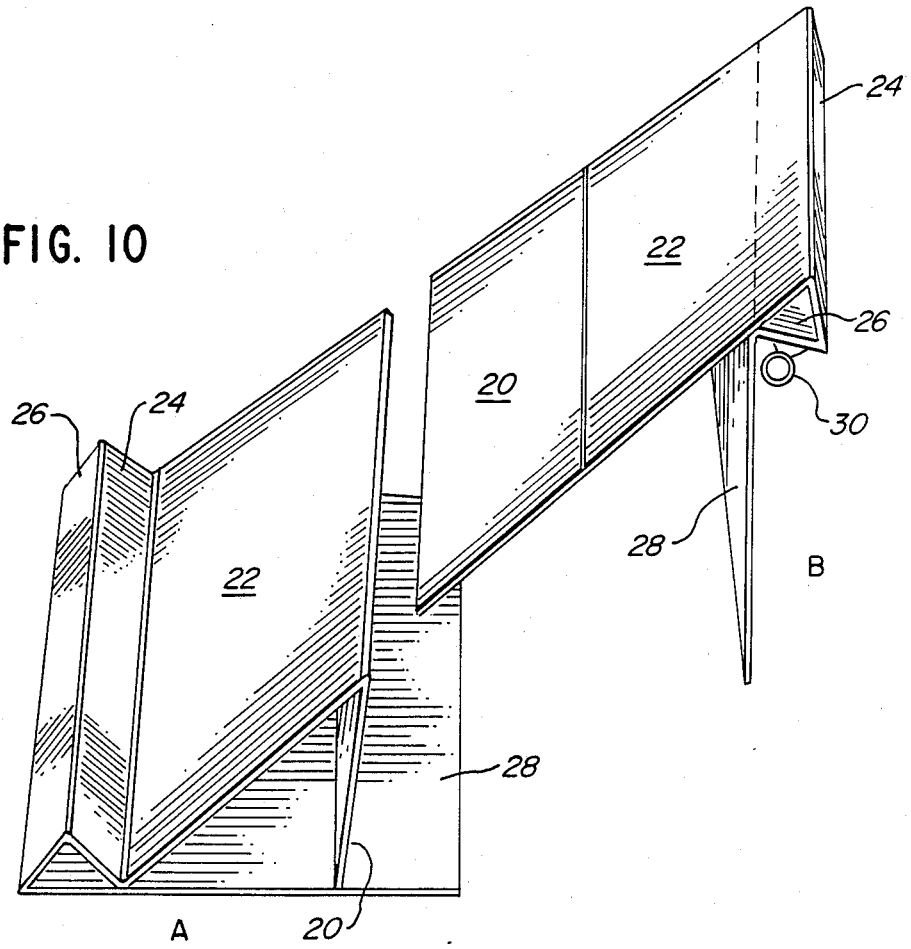
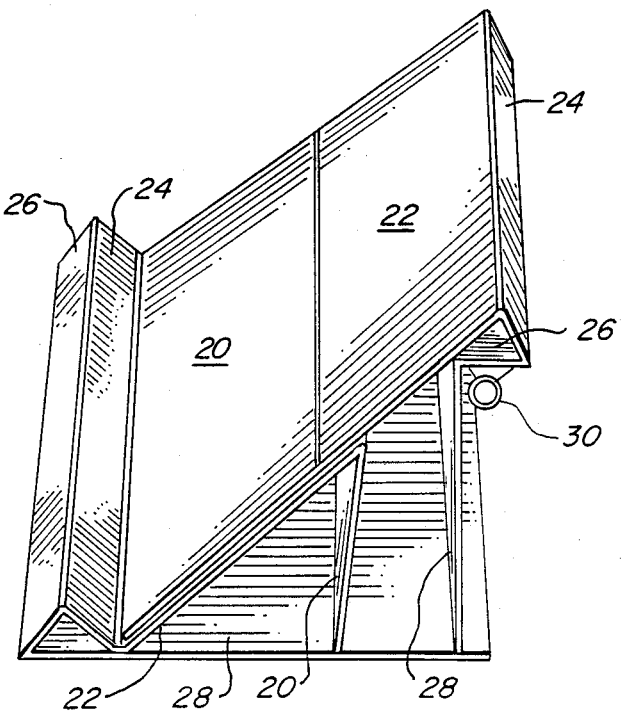
FIG. 11

FIG. 15
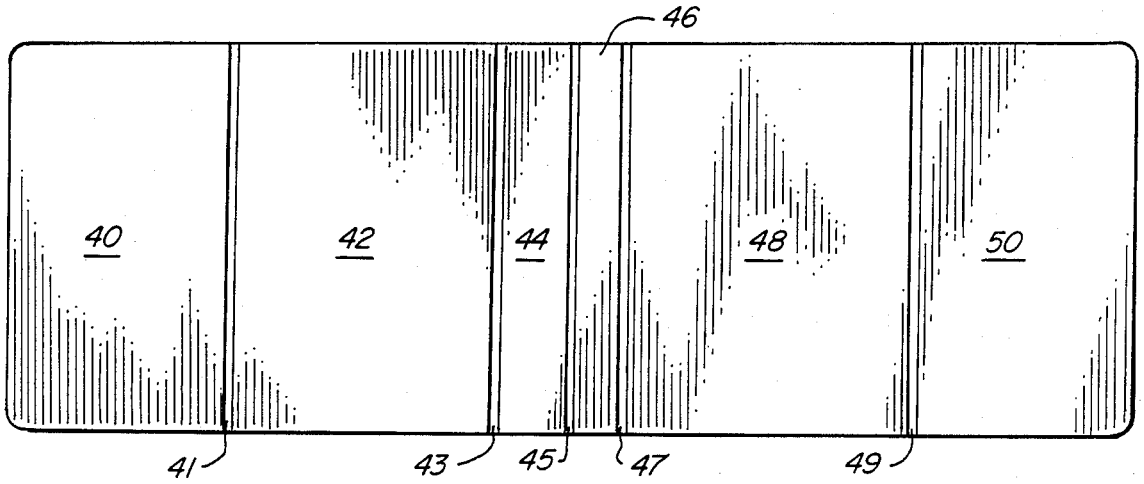
FIG. 16
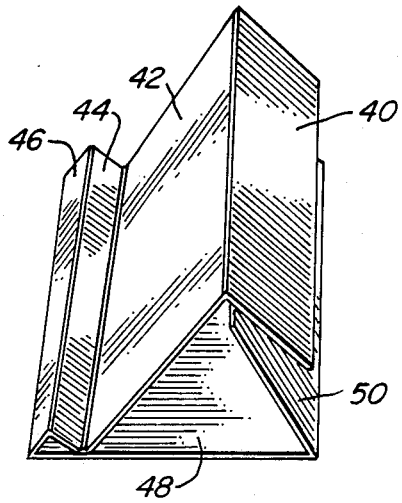
FIG. 17
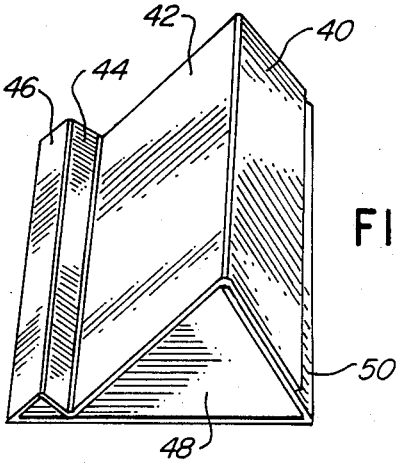
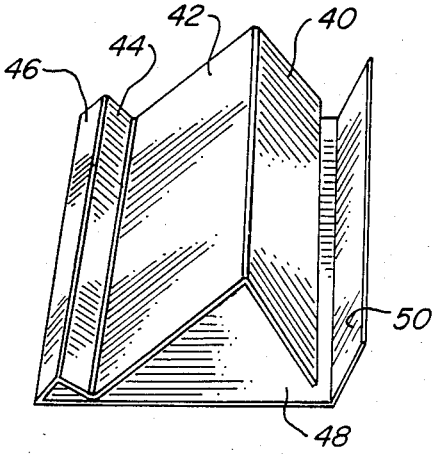
FIG. 18
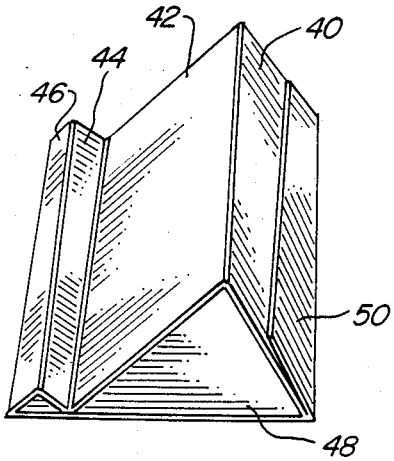
FIG. 19

GRAVITY LOCK BOOKSTAND AND BINDER

The present invention represents a new design and construction comprising the necessary elements for a satisfactory solution to the basic need for a strong, portable, collapsible and inexpensive bookstand. Numerous bookstands have been marketed with very limited success; their use is hardly common.

The patent literature abounds with ingenious, intricate and impractical solutions which have not been viable commercially. The present invention addresses the main requirements of extreme simplicity, maximum portability, lowest cost, quick set up and folding procedure while exhibiting exceptional stability through its principle of gravity lock. Additional objects of this invention are ease of manufacture, provision for simple page holding and integration of the bookstand with a ring binder which will promote the portability and the acceptance of the bookstand. Another object has been the proportioning of the panels of the combination so that additional useful configurations could be erected from the same preferred embodiment. Another object still has been the integration of the bookstand with a book cover and in still another embodiment, maximum flatness in compact folding has been achieved with two angular display choices as a bookstand for seated reading or as a lectern for standing reading.

BRIEF DESCRIPTION OF THE DRAWINGS

FIG. 2 is a view of the partially closed ring binder-bookstand.

FIG. 3 shows the ring binder-bookstand fully closed.

FIG. 4 shows a partially opened bookstand not fully erected.

FIG. 5 shows the fully open and erected bookstand.

FIG. 6 is a view similar to FIG. 5, showing the elastic cord used for retaining the book's pages flat.

FIG. 7 shows the fully erected bookstand with a book whose pages are being held in place by an elastic cord.

FIG. 8 shows the ring binder in the process of being placed in the configuration of FIG. 9 to become a miniature drawing board.

FIG. 10 illustrates two juxtaposed ring binders which become in FIG. 11 a larger sturdier stand.

FIG. 12 illustrates the reversely erected ring binder-stand as it becomes a demonstration easel.

FIG. 13, the rear view of FIG. 12 also shows that side's configuration able to function as a bookstand.

FIG. 14, a rearranged configuration of both FIGS. 12 and 13, shows a lectern type of bookholder.

FIG. 15 is a plan view of a six panel embodiment of the ring binder-stand combination for mobile stability.

FIGS. 16, 17, 18 and 19 show alternative forms of erecting the bookstand.

FIG. 1 shows a plan view of the initial stage of construction for the preferred embodiment. FIG. 1 illustrates a blank piece of material composed of five panels: 20, 23, 24, 26, 28, connected sequentially by hinges numbered 21, 23, 25, 27. Panel 20 serves as the vertical support member which in gravity lock sustains the erected bookstand, panel 22 serves as the back-rest for the displayed material, panel 24 serves as the rear and downwardly inclined shelf on which the bottom of the displayed book can rest, panel 26 is the spine or backbone of the loose leaf ring binder which also provides the elevation from which panel 24 slopes downwardly in the erected stand and panel 28, the rear cover of the ring binder is also the base of the erected stand. FIG. 2 shows the open ring binder with ring mechanism 30, attached to panel 26. FIG. 3 shows a closed view of the ring binder which represents also the folded bookstand. FIG. 4 represents the partially opened bookstand where support panel 20 is seen moving away from rotating panel 22. FIG. 5 illustrates the erected bookstand in which panel 20 is seen to rest vertically on panel 28, the spine or panel 26 is shown maintaining its backbone role and panels 24 and 22 are seen forming a right angle cradle as shelf and back-rest panels create a secure nest for the displayed book. FIG. 6 shows the erected stand with an elastic cord 31 on panel 22 in order to hold flat the pages of the displayed book as illustrated in FIG. 7. Panel 20 will not slip or drift from its edge contact in perpendicularity with panel 28 and will develop increasing stability with increasingly heavier loads.

The vertical component of the gravitational force acting on the displayed material presses the edge of panel 20 firmly against base panel 28. This gravity lock feature is a very real one and can be experienced by placing a finger between the interface of panels 20, and 28 when loaded with a heavy book. The correct proportions between panels 20, 22, 24, 26 define a 90 degree angle which best retains the bottom of the book against forward slippage which would have to occur forward and upwardly. FIGS. 8 and 9 show the erection of the closed binder into a lectern type of bookstand which can also serve as an auxilliary drawing board. This configuration is obtained by pushing the front cover of the binder back towards the spine, causing said spine to lie flat as an extension of the rear cover upon which, the shelf panel 24 becomes the acting spine of the erected lectern, as panel 22 assumes a slanted 20 degree position suitable for a standing or lecturing reader. We will now describe a unique configuration: the asembled combination of two ring binders into a larger display stand and the further application of two such composites into very large display stands capable of holding larger and heavier display objects. As illustrated in FIG. 10, two ring binders are to be engaged, the first one erected in the described bookstand position as has been shown in FIGS. 5 and 6. Juxtaposed and above, another ring binder is shown opened to an angle in excess of 270 degrees. FIG. 11 shows the completed assembly. The panels in each case bear similar numeration; the binders are also identified as A for the first one and B for the second one, that their actual position in FIG. 11 may be clearer.

Figure 1:
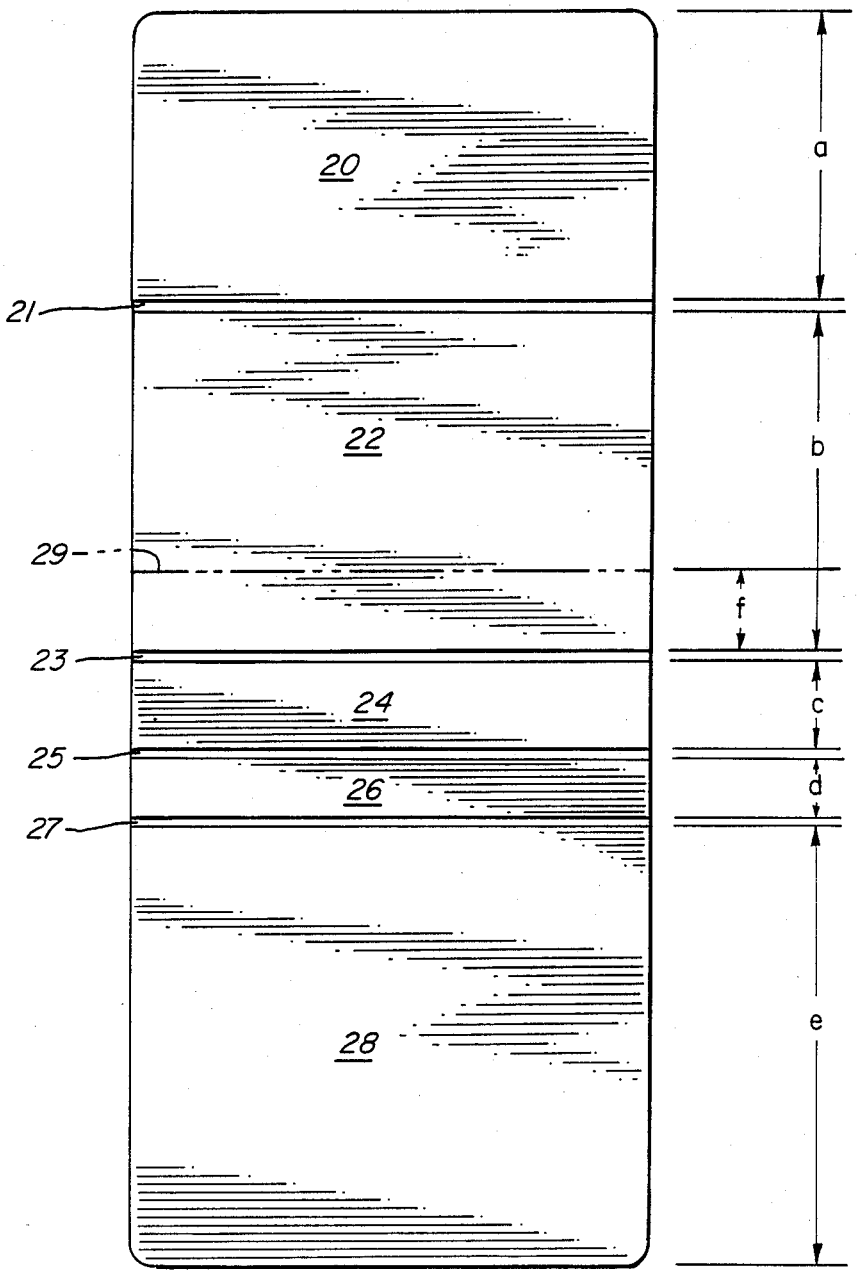
FIG. 1 is a plan view of a blank piece of material consisting of five panels joined by four hinges.

When two such composite combinations are placed in parallel, spaced apart, they will support much larger and heavier material such as framed paintings, large framed maps or a drawing board from which displays, group discussions are facilitated. Two such composites back to back, spaced apart, will hold large flip charts in vertical display. These combinations are feasible only because of the designed proportionality between the various panels as exemplified in the equation described in the next page, in which the widths of panel 20, 22, 24, 26, 28 are labeled respectively, a, b, c, d, e. Defining the distance from line 29 to hinge 23 in FIGS. 10 and 11 as f, also equivalent to the width of panel 24 (or c), we postulate the following equation which states an optimal relationship which makes the configuration of FIG. 11 feasible and stable when loaded with the displayed material.

The proportionality equation is:

$$\frac{a+b-c}{e}=\frac{b}{a}$$

Under these conditions the configuraton of FIG. 11 is stable. When these proportions are departed from, the feasibility of FIG. 11 is threatened even as the stability of FIGS. 5, 6 and 7 is still maintained. The optimally specified proportions however, provide optimal stability in all applications described. Other single configurations best erected under the optimal proportionality described above, are exemplified in FIGS. 12, 13 and 14 where the totally opened and inversely closed ring binder stably linked through manual fastening means 32 & 33 on panels 20 and 28, exhibit respectively an easel, a typing copyholder and a lectern type of bookholder.

All these configurations are predicated on the preferred embodiment discussed. FIG. 15 shows a blank piece of material composed of six panels, 40, 42, 44, 46, 48, 50. The six panel bookstand is shown in two states of erection in FIGS. 16 and 17. Panel 40 is seen fitting over upraised larger panel 50 whose free edge is trapped under hinge 41 and whose engagement is maintained by the weight of the displayed book in gravity lock. An opposite alternative is displayed in FIG. 18 which shows the six panel bookstand in partial state of erection. In FIG. 19 we see longer panel 40 placed at hinge 49 which ensconces the edge of inclined panel 40, holding it securely in gravity lock when loaded with a book.

Figure 20:
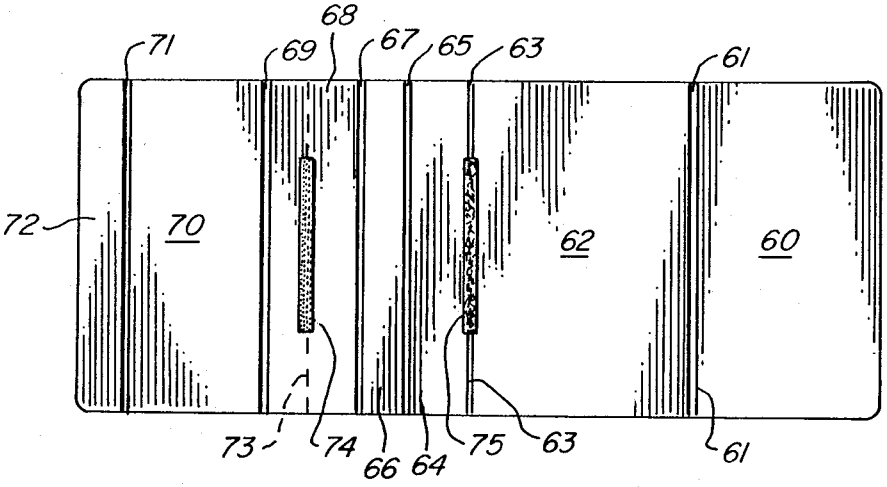
FIG. 20 is a plan view of the seven panel embodiment which is capable of very compact closing for optimum portability.
Figure 22:
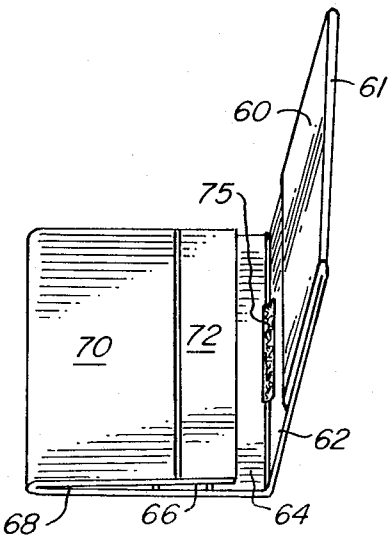
FIGS. 21, 22, 23 demonstrate the gradual closing of the seven panel bookstand.

Another useful embodiment is illustrated in FIGS. 20, 21, 22, and 23. In FIG. 20, seven panels numbered from right to left, 60, 62 64, 66. 68, 70, 72 are sequentially connected by hinges 61, 63, 65, 67, 69 and 71. Manual fasteners 75 and 74 are repectively located on hinge 63 and on line 73. Line 73 is spaced from hinge 67 so that on erection panels 66, 64 may form a right angle as panel 64 in the erected stand slopes downwardly and rearwardly, that it may support the bottom of a displayed book. In effecting full closure of this bookstand embodiment, hinge 63 becomes the slim spine of the compactly folded stand. As observed in FIG. 21 and is further illustrated in FIGS. 22 and 23, panels 70 and 72 plus hinge 71 have an approximate total width equivalent to that of panel 60, and serve as internal flaps in the folded bookstand.

Figure 23:
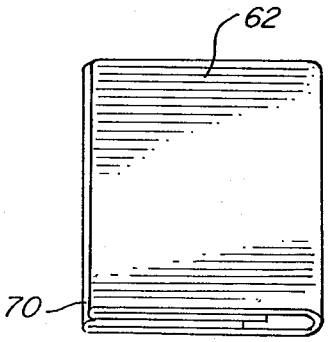
Figure 21:
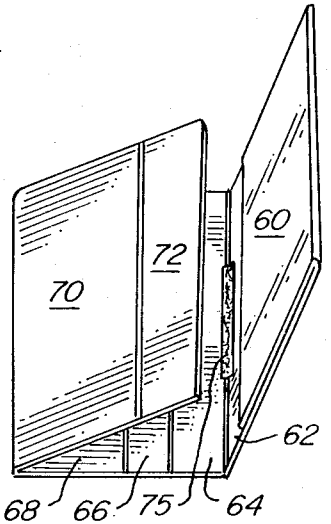
Figure 24:
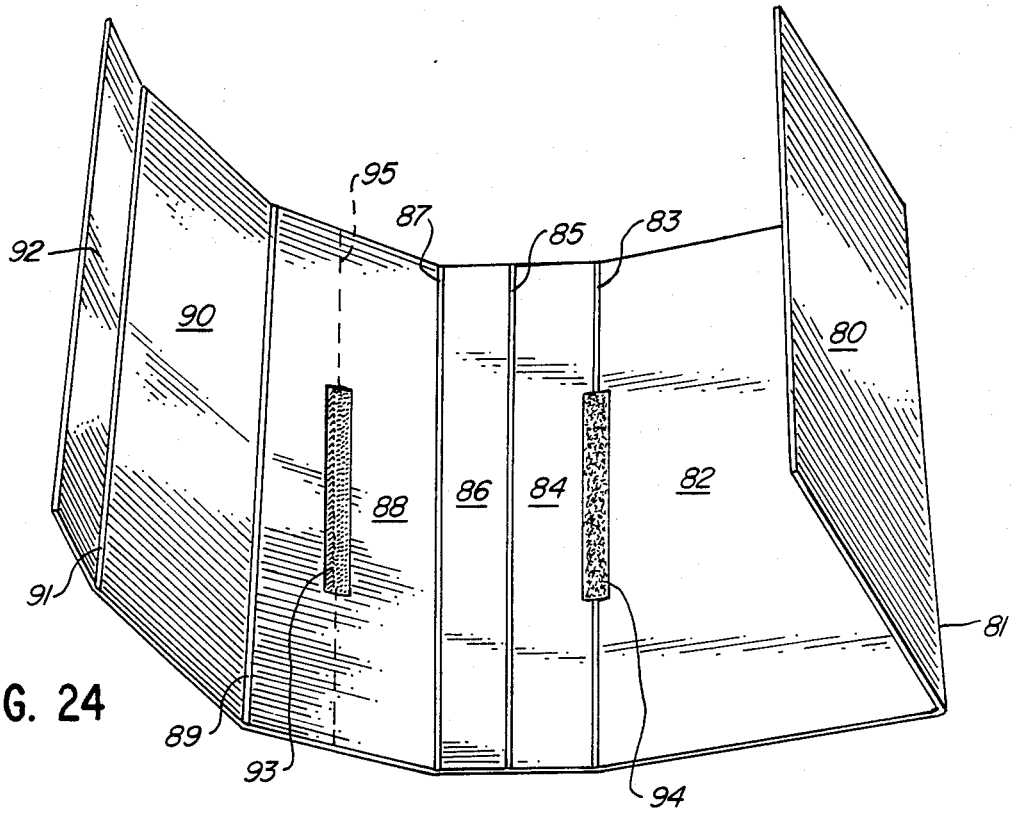
FIG. 24 shows a partially open view of the combination bookcover and bookstand.
Figure 25:
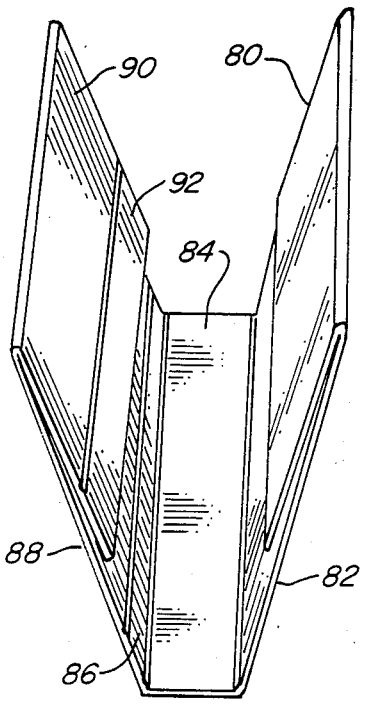
FIG. 25 shows the fully closed book cover without a book.
Figure 26:
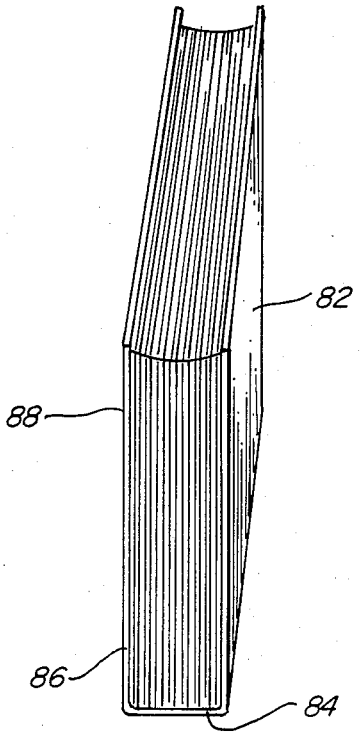
FIG. 26 shows the fully closed bookcover containing a book inside it.

Also, the sum of the widths of panels 64, 66 and 68 with their intervening hinges, 65 and 67, will approximately equal the width of panel 62 which accounts for the symmetric aspect of the folded stand of FIG. 23, which compactness promotes the portability of the bookstand. Still another valuable embodiment also composed of seven panels, differently proportioned, will serve as a bookstand and as a bookcover. FIGS. 24, 25, and 26 show the bookcover and bookstand combination.

In FIG. 24, panels 80, 82, 84, 86, 88, 90 and 92 are sequentially connected by hinges 81, 83, 85, 87, 89 and 91. Optional manual fasteners 94 and 93 are located respectively at hinge 83 and line 95, whose distance from hinge 87 will permit panel 84 which also serves as the bookcover spine to become the bottom support shelf in the erected bookstand. Symmetric book covers on both sides result from proportioning panels 86 and 88 plus hinge 87 to equal the width of panel 82 or the right side of the cover in FIG. 26. Likewise panels 90, 92 and hinge 91, will effectively equal right inside cover panel 80, which is the vertical support for the erected bookstand. This bookcover could be made of plastic or light cardboard, with decorative art or custom made promotional book jackets.

I claim:

1. I claim a collapsible display stand from an elongated flat structure comprising five panels of relatively stiff sheet like material sequentially hinged in manufacture, said elongated structure being foldable into a compact display stand with the first panel sandwiched in substantial planar tangency within the second and fifth panels, the second and third panels serving as the top cover, the fourth panel acting as the spine or backbone and the fifth panel becoming the rear or bottom cover of the closed display stand, from which collapsed state it can be readily erected by lifting the second panel pivoted on its commmon hinge with the third panel, allowing the first panel which becomes a support panel to rest perpendicularly on the fifth panel which becomes the display stand's base panel, the second panel leaning rearwardly becomes a back-rest panel for the display material, said second panel forming a tilted approximate right angle with the attached downwardly sloping third panel which becomes an inclined shelf panel, supported in elevation through its common hinge by the upright fourth panel or backbone panel serving now as the display stand's front support panel, means for maintaining rigidly this approximate quadrature relationship between second and third panels, thus forming a secure well on which the bottom of the display material can rest preventing forward and upward slippage, as the vertical component of the displayed material's weight pulls said first panel in secure gravity lock when placed on a flat level surface, this gravity lock force disappearing with the removal of the load, allowing easy collapse and folding of the display stand.

2. A collapsible display stand according to claim 1 further characterized by the attachment of a loose leaf ring mechanism enabling the collapsed display stand to function as a loose leaf ring binder, said ring mechanism being internally attached to the display stand-ring binder combination so that it effectively maintains the approximate quadrature relationship between the second and third panels, thus forming a secure well on which the bottom of the display material can rest preventing forward and upward slippage, as the vertical component of the displayed material's weight pulls said first panel firmly against the fifth panel, or the intervening loose leaf pages inserted in the ring binder, in secure gravity lock when placed on a flat, level surface, this gravity lock force disappearing with the removal of the load, allowing easy collapse and folding of the display stand which can now resume its function as ring binder.

3. A collapsible display stand according to claim 2, further characterized by the quick erection of a lectern type of book support from the closed bookstand and ring binder combination, which configuration is readily obtained by pushing the front cover of the flatly placed binder back towards the spine, causing said spine or fourth panel to lie flat as an extension of rear cover fifth panel, upon which shelf panel, the third panel becomes the acting spine of the erected lectern, able to hold a book securely at an angle of about 20 degrees, with the book actually resting on inclined second panel as the first panel has been pushed back to the ring mechanism, the configuration thus obtained being able to serve also as an inclined small drawing or sketching board.

4. A collapsible display stand according to claim 1, further characterized by having an elastic cord looped or attached to across the width of the second panel, permitting said cord to be stretched across the pages of an open book placed on the display stand, for the purpose of holding said pages flat against the open book for comfortable reading, permitting also the easy turning of the pages as the reading progresses.

5. A collapsible display stand according to claim 1, further characterized by specifying that the widths of each of the five panels as described in claim 1, hereby labeled, a, b, c, d and e respectively for the first, second third, fourth and fifth panels be related as described by the equation $$\frac{a+b-c}{e}=\frac{b}{a},$$

under which proportionality, two juxtaposed and inversely stacked stands can be quickly assembled to constitute a larger display stand of significant strength and stabiity, able in parallel combinations to hold in display ever larger and heavier display material.

6. A collapsible display stand according to claim 1, further characterized by the attachment of manual fastening means to the longer free edge of the fifth panel on the lower outer surface marginal to the first panel's free edge, which makes feasible the reverse erection of additional support related configurations, including an easel at near vertical angle for flip chart demonstrations, a typing copy holder aid at an approximate 80 degree angle and a lectern type of book holder for standing readers at an appropriate angle of about 30 degrees.

7. A collapsible display stand according to claim 1, further characterized by having a sixth panel hingedly connected to the fifth panel which permits a second display attitude as the first panel's free edge can be ensconced at the hinged connection between the fifth and sixth panels upon erection, with the further option of draping said first panel over said sixth panel's free edge which then remains stably trapped under the common hinge of the first and second panels in secure gravity lock when loaded with the display material and placed on a flat surface, this gravity lock force disappearing with the removal of the load, allowing easy collapse and folding of the display stand.

8. A collapsible display stand according to claim 7, further characterized by attached manual means of fastening the interfacing surfaces of the first and sixth panels, permitting stable moving of the erected and loaded stand without collapse.

9. A collapsible display stand according to claim 1, further characterized by the attachment of manual fastening means at the interface between the hinge joining the second and third panels and the line of contact with the fifth panel in the erected display stand, at which position the second and third panels form an approximate right angle, rigidly maintaining this relationship, forming a secure well on which the bottom of the display material can rest preventing forward and upward slippage, as the vertical component of the displayed material's weight pulls said first panel firmly against the fifth panel in secure gravity lock when said first panel is placed perpendicular to said fifth panel on a flat level surface, allowing, upon removal of the load, manual detachment of the fastened surfaces, permitting the closed display stand to be folded in a flat form without the backbone bulge or to be used as a book carrier or cover.

10. A collapsible display stand according to claim 9, further characterized by having a sixth panel connected to the fifth panel by a hinge whose distance from the common hinge of the second and third panels will be substantially equivalent to the width of the second panels resulting in the combined width of the fifth and sixth panels being equivalent to the combined width of the second and third panels under which proportions the display stand will fold into a more compact form whose closed width is equivalent to that of the second panel resulting in a thinner, folded bookstand without a backbone bulge.

11. A collapsible display stand according to claim 10, further characterized by having a seventh panel, serving the purpose through attached manual fastening means of permmitting the erected display stand to assume the bookstand position as the interface of the first and seventh panels are held together in planar tangency allowing mobility without loss of stability of the erected stand.

12. A collapsible display stand according to claim 9, further characterized by having a sixth panel whose common hinge with the fifth panel located at a distance from the common hinge of the third and fourth panels equivalent to the width of the second panel resulting in the combined widths of the fourth and fifth panels being equivalent to the width of the second panel permitting the sixth panel to fold over the fifth panel when the display stand is collapsed when it can function as a book cover which uses the third panel as the bookcover's spine, the rear cover of said bookcover being composed of the fourth and fifth panels while the sixth panel folds over the book's front cover with the second panel becoming the front cover of the book.

13. A collapsible display stand according to claim 12 further characterized by having a seventh panel hingedly connected to the sixth panel serving the purpose of permitting said seventh panel to be upraised at its hinge to meet in planar tangency the surface of the first panel in the erected stand locking both panels securely for stable mobility with the provision that the combined widths of the sixth and seventh panels be equivalent to the width of the first panel, resulting in a symmetrical book cover whose internal flaps would be at one end, the first panel, and at the other end the combined sixth and seventh panels, the two outer covers being respectively the second panel and at the other end the combined fourth and fifth panels as the backbone or spine of the book cover is the third panel which serves as the leaning shelf for the support of the displayed book in the erected stand.

* * * * *